United States Patent [19]

Sato et al.

[11] 4,200,857

[45] Apr. 29, 1980

[54] VARIABLE RESISTOR

[75] Inventors: Mikio Sato, Furukawa; Kozo Magami, Tohda, both of Japan

[73] Assignee: Alps Electric Co., Ltd., Tokyo, Japan

[21] Appl. No.: 874,019

[22] Filed: Jan. 31, 1978

[30] Foreign Application Priority Data

Feb. 1, 1977 [JP] Japan ..... 52-10747[U]

[51] Int. Cl.[2] ..... H01C 10/34

[52] U.S. Cl. ..... 338/174; 338/125; 338/162; 338/314

[58] Field of Search ..... 338/174, 175, 171, 125–128, 338/160, 162, 185, 188, 190, 123, 307, 308, 314, 322–325, 328, 334

[56] References Cited

U.S. PATENT DOCUMENTS

| | | | |
|---|---|---|---|
| 2,269,136 | 1/1942 | Tellkamp | 338/325 X |
| 3,898,606 | 8/1975 | Dumas et al. | 338/174 X |

FOREIGN PATENT DOCUMENTS

| | | | |
|---|---|---|---|
| 804548 | 8/1936 | France | 338/174 |

*Primary Examiner*—C. L. Albritton

*Attorney, Agent, or Firm*—Guy W. Shoup; Gerard F. Dunne

[57] ABSTRACT

A variable resistor suitable for use in the tone control of a stereo tape player or the like has two resistance bodies formed on an insulating substrate plate so as to oppose one another. Under one of the resistance bodies is formed a lead conductor, through an interposed insulating layer. The lead conductor is connected to one end of the associated resistance body and leads to the other end portion of this resistance body, so that the terminals of both resistance bodies can be located at the same side of the insulating substrate plate, thereby to diminish the size of the variable resistor.

3 Claims, 5 Drawing Figures

VARIABLE RESISTOR

BACKGROUND OF THE INVENTION

The present invention relates to variable resistors and, more particularly, to a rotary type variable resistor suitable for use in the tone control circuit of a stereo tape player or the like.

In conventional variable resistors of the type described, as shown in FIG. 1 for example, arcuate resistance bodies 2 and 3 are formed on an insulating substrate plate 1, so as to oppose one another. The resistance bodies 2, 3 are each connected at one end thereof to respective terminals 4 and 5, through conductive portions 2*b* and 3*b*, respectively. Other conductive portions 2*a* and 3*a* are connected to the other ends of the resistance bodies 2,3. A slide 8 adapted to slide on the resistance bodies 2,3 and contact a collecting body 6 is carried by a shaft which passes through a shaft bore 9 in the plate 1. As the shaft is rotated, opposing contacts 8*a* and 8*b* slide on the respective resistance bodies 2,3 in opposite directions, so as to constitute an electric circuit for adjusting the voltages of both sides as shown diagrammatically in FIG. 2.

Recently, the demand for diminishing the size of electric parts is increasing. This is true especially in the case of variable resistors for stereo players for automobiles or the like, and the smaller size of variable resistors is desired.

However, this requirement cannot be satisfied well by the conventional variable resistors because the terminals 4 and 5 project from opposite sides of the insulating substrate plate, so as to occupy a relatively large space.

It is therefore an object of the invention to avoid the above described inconvenience in the prior art by providing an improved variable resistor.

SUMMARY OF THE INVENTION

According to the present invention, to this end, there is provided a variable resistor in which terminals of two resistance bodies are located at the same side of the insulating substrate plate, so as to diminish the overall dimension of the resistor.

DETAILED DESCRIPTION OF THE PREFERRED EMBODIMENTS

Figure 1:
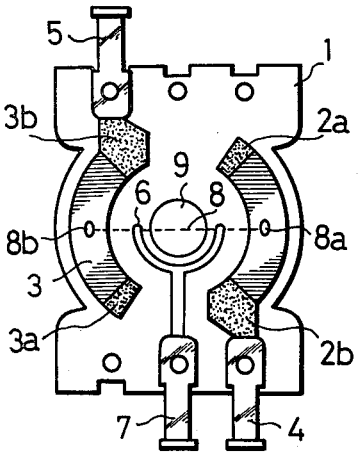
Fig.1 Prior Art
FIG. 1 is a plan view of a conventional variable resistor.
Figure 2:
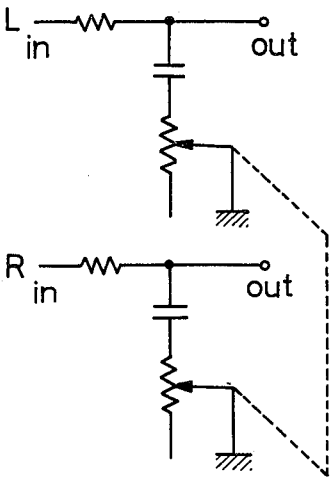
FIG. 2 is a circuit diagram of an example of a tone control circuit.
Figure 3:
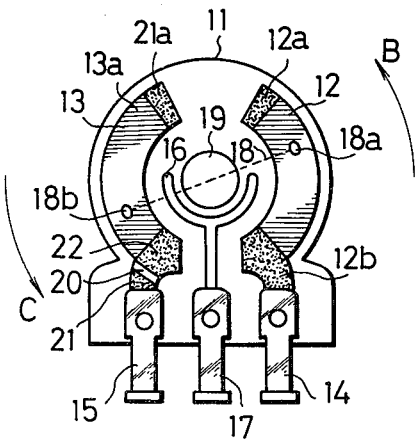
FIG. 3 is a plan view of a variable resistor embodying the present invention.

Referring to FIG. 3 showing an embodiment of the present invention, numerals 11, 12 and 13 denote, respectively, an insulating substrate plate, and opposing resistance bodies of the same size and arcuate shape.

The resistance bodies 12 and 13 are disposed at respective sides of a collecting body 16 which is connected to an intermediate terminal 17.

Figure 4:
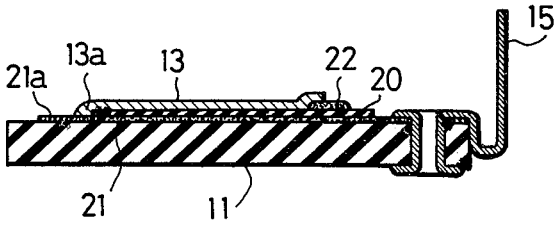
FIG. 4 is a sectional view of essential parts of the variable resistor of FIG. 3.

The first resistance body 12 is formed in the same manner as the resistance bodies in conventional resistors, with a connection to a first terminal 14. The second resistance body 13, however, is formed in a specific manner as shown in FIGS. 3 and 4.

Namely, at first an arcuate lead conductor 21 is formed on the insulating substrate plate 11, for example by a printing of silver paste on the substrate, at a location thereon where the resistance body 13 otherwise would be formed. The conductor 21 leads to a third terminal 15. On the whole of the lead conductor 21 other than both end portions, an insulating film 20 is formed. Subsequently, conductive portion 22 is formed, so as not to contact the lead conductor 21, at the side of the insulating film 20 where the third terminal 15 is located. Finally, the resistance body 13 is formed to interconnect the end 21*a* and the conductive portion 22, for example, by engaging an end portion 13*a* of the resistance body 13 with the extended end 21*a* of the lead conductor while overlapping the other end portion of the resistance body 13 upon the conductive portion 22, as can be clearly seen in FIG. 4. End portion 21*a* thus forms a conductive portion.

In this way, the conductive portion 22 and the lower most lead conductor are separated by the insulating film and connected electrically to each other only through the resistance body 13.

The resistance bodies are contacted slidingly by respective slide portions 18*a* and 18*b* of the slide 18 carried by a common shaft (not shown). The slide portions are moved in the directions of arrows B and C, respectively, so as to increase or decrease the resistance to the terminals 14 and 15 at the same rate.

Thus, in a variable resistor constructed according to the present invention, a pair of opposing resistance bodies are formed on an insulating substrate plate. Beneath one resistance body, formed with an interposed insulating layer is a lead conductor which is connected to the resistance body and leads to the other end portion of the resistance, so that the terminals of both resistance bodies can be conveniently located at one side of the insulating substrate body. Therefore, a variable resistor according to the present invention has a smaller size than conventional ones, and is easy to assemble. In addition, the space for circuit connections can be much diminished.

Figure 5:
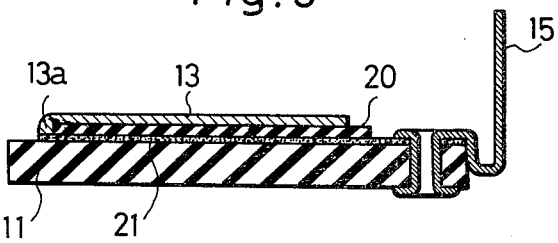
FIG. 5 is a sectional view of another embodiment of the present invention.

In another embodiment of the present invention, shown in FIG. 5, the arcuate conductor 21 is formed beneath an insulating film 20, in such relation with the second resistance body 13 that an end of the conductor 21 can be connected to the end 13*a* of the latter, as can clearly be seen in FIG. 5. It will be seen that the variable resistor of FIG. 5 can perform an excellent function as provided by the embodiment of FIGS. 3 and 4. In addition, in the embodiment of FIG. 5, the step of forming the condutive portion 22 can be eliminated.

What is claimed is:

1. A variable resistor comprising an electrically insulating substrate plate;

a pair of opposing resistance bodies provided on said plate;

means including a slide adapted to contact said resistance bodies for varying the resistance value between output terminals connected to respective ones of said resistance bodies;

a lead conductor provided beneath one of said resistance bodies;

an insulating layer provided between said lead conductor and said one resistance body, said lead conductor being connected to one end portion of said one resistance body and extending to the other end portion of said one resistance body, whereby, said terminals can be located at the same side of said plate; and further including conductive portions connected to respective end portions of said resistance bodies, the conductive portion connected to said one end portion of said one resistance body being constituted by an extended end of said lead conductor.

2. A variable resistor according to claim 1, said slide slidably contacting a collector located between said resistance bodies and having two slide portions each slidably contacting respective resistance bodies, whereby the electrical resistance between the respective terminals of said resistance bodies and said collector can be varied equally.

3. A rotary variable resistor for varying the resistance value equally to each of a first and second output terminals, comprising a substrate plate formed from an electrically insulating material;

two generally similar arcuate resistance bodies carried in opposing relationship by said substrate plate, said resistance bodies being isolated electrically from one another on said substrate plate;

a slide slidably contacting a collecting body located between said two resistance bodies and having two slide portions adapted to slide in unison along respective ones of said resistance bodies;

a first output terminal connected electrically to an adjacent end portion of one of said resistance bodies;

a second output terminal connected electrically to the remote end portion of the other resistance body, said second output terminal being connected to said remote end portion by a lead conductor running beneath said other resistance body and interconnecting said second output terminal and said remote end portion, whereby the first and second output terminals can be located near one another; and an insulating layer provided between said lead conductor and said other resistance body lying thereover.

* * * * *